US008133063B2

(12) United States Patent
Tay

(10) Patent No.: US 8,133,063 B2
(45) Date of Patent: Mar. 13, 2012

(54) CONNECTOR WITH REMOVABLE COVERS

(75) Inventor: Koon Poh Tay, Singapore (SG)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/733,923

(22) PCT Filed: Sep. 27, 2007

(86) PCT No.: PCT/IB2007/054338

§ 371 (c)(1),
(2), (4) Date: Apr. 12, 2010

(87) PCT Pub. No.: WO2009/040612

PCT Pub. Date: Apr. 2, 2009

(65) Prior Publication Data

US 2010/0297859 A1 Nov. 25, 2010

(51) Int. Cl.
*H01R 12/13* (2006.01)

(52) U.S. Cl. ..... 439/83

(58) Field of Classification Search ..... 439/83, 439/630, 637, 135, 260, 79
See application file for complete search history.

(56) References Cited

U.S. PATENT DOCUMENTS

| | | | | | |
|---|---|---|---|---|---|
| 4,780,095 | A | * | 10/1988 | Classon et al. | 439/637 |
| 5,358,413 | A | * | 10/1994 | Daly et al. | 439/79 |
| 5,449,297 | A | * | 9/1995 | Bellomo et al. | 439/630 |
| 5,470,237 | A | | 11/1995 | Byczek et al. | 439/76.1 |
| 5,692,912 | A | * | 12/1997 | Nelson et al. | 439/79 |
| 6,955,546 | B1 | * | 10/2005 | Huang | 439/135 |
| 7,347,725 | B2 | * | 3/2008 | Sakamoto | 439/566 |
| 7,883,344 | B1 | * | 2/2011 | Felton et al. | 439/135 |

FOREIGN PATENT DOCUMENTS

| | | | |
|---|---|---|---|
| EP | 918 379 | A2 | 5/1999 |
| EP | 921 610 | A2 | 6/1999 |
| KR | 10-1999-0062762 | | 7/1999 |
| KR | 10-2006-0093873 | | 8/2006 |

* cited by examiner

*Primary Examiner* — Alexander Gilman
(74) *Attorney, Agent, or Firm* — Harrington & Smith

(57) ABSTRACT

An electrical connector including a housing; one or more recesses formed in one or more sidewalls of the housing; a plurality of terminals disposed in respective portions of the housing such that solder tails of the terminals are accessible through the one or more recesses; and one or more cover elements removably coupled to the one or more sidewalls of the housing such that, in a mounted state of the connector on a PCB, the solder tails are enclosed by the one or more cover elements.

20 Claims, 4 Drawing Sheets

CONNECTOR WITH REMOVABLE COVERS

FIELD OF INVENTION

The present invention relates broadly to a connector such as receptacle connectors.

BACKGROUND

Receptacle connectors such as SCA-2 receptacles are often soldered onto printed circuit board (PCBs). In such PCB assembly processes, pick-up devices or caps are typically utilised to allow the pick and place process for the receptacles to be positioned on the PCBs.

In receptacle connectors such as SCA-2 receptacles, surface mount type electrical terminals are typically provided. For allowing access to solder connections to the terminals, a recess is typically formed in the walls of the receptacle in the areas of the solder tails of the terminals, for facilitating soldering, inspection, and maintenance of the solder connections. The existence of the recesses, however, is associated with a number of disadvantages, including that the solder connections, in a mounted state of the receptacle on a PCB, are potentially exposed to dust or other particles, which can result in damage or deterioration of the solder connections. Furthermore, electrical shortening of adjacent terminals may be caused.

It is with the knowledge of the abovementioned issues that the present invention has been made and is now reduced into practice.

SUMMARY

In accordance with an aspect of the present invention there is provided an electrical connector which has a housing; one or more recesses formed in one or more sidewalls of the housing; a plurality of terminals disposed in respective portions of the housing such that solder tails of the terminals are accessible through the one or more recesses; and one or more cover elements removably coupled to the one or more sidewalls of the housing such that, in a mounted state of the connector on a PCB, the solder tails are enclosed by the one or more cover elements.

Example embodiments of the invention can achieve a number of advantages, including protection of the solder connections to the solder tails of terminals of the receptacle by way of the one or more cover elements.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION

Figure 1:
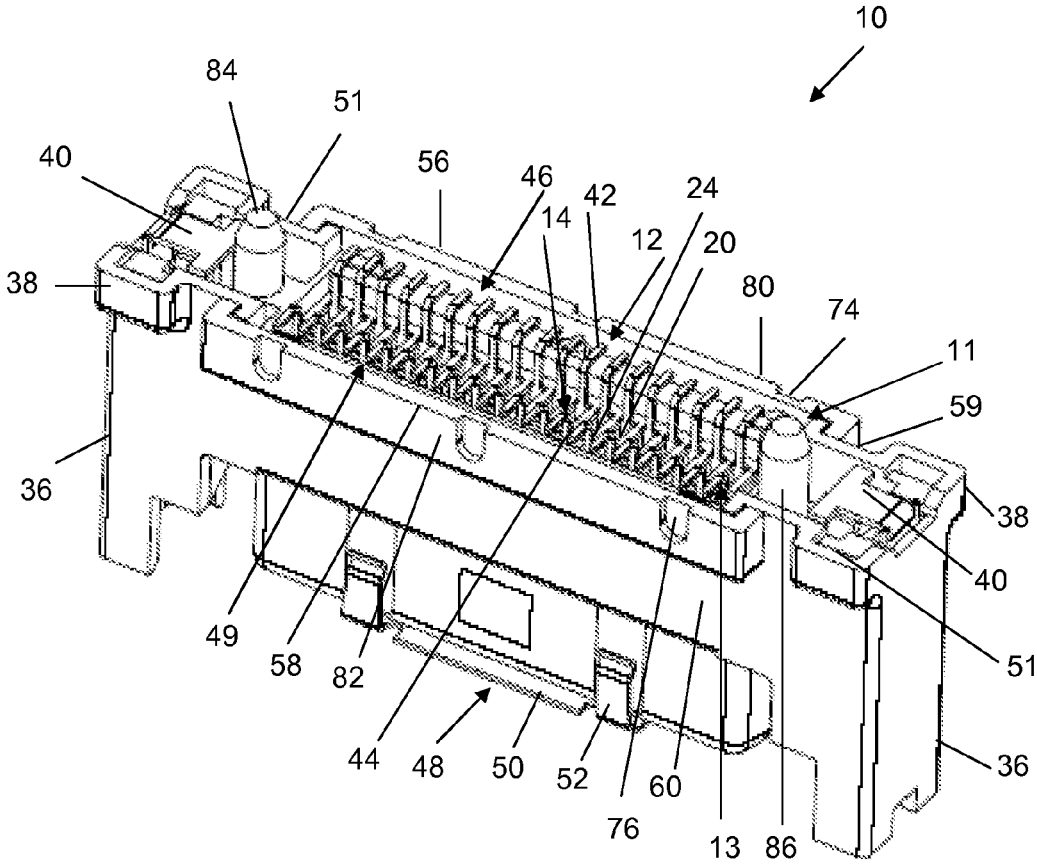
FIG. 1 is a perspective bottom view of the SCA-2 receptacle connector according to an embodiment of the present invention.

FIG. 1 shows a perspective bottom view of a SCA-2 (SCA-2 Receptacle 40 Pos Extended Height Vertical SMT) receptacle connector 10 according to an example embodiment. The receptacle connector 10 is molded using high temperature thermo-plastic in the example embodiment, to accommodate electrical terminals 12, 14. The receptacle connector 10 has two arrays 11, 13 of terminals, arranged on different sides of the receptacle connector 10. The first array 11 consists of twenty terminals e.g. 12 of 1.27 mm pitch and is located towards one side of the receptacle connector 10, along one edge thereof, each terminal 12 being positioned in their respective chambers 20. The terminals 12 of the first array 11 usually connect signal lines, and are made from copper alloy in the example embodiment.

Similarly, the second array 13 consists of twenty terminals 14 of 1.27 mm pitch. The second array 13 is located towards the other edge of the receptacle connector 10 which is opposite to the edge having the first array 11. Each terminal 14 is positioned in respective chambers 24. The terminals 14 of the second array 13 also usually connect signal lines.

Each of the ends of the receptacle connector 10 is terminated with a vertically positioned pillar 36 having a horizontally positioned base 38. On each of the bases 38, a metallic bent T-shaped solder tail-type clip or hold down 40 is provided to enable the receptacle connector 10 to be held down on a PCB. The hold down 40 is made from copper alloy in the example embodiment, and is inserted from the bottom (i.e. the face facing the PCB in a mounted configuration) of the connector 10. For connection of the receptacle connector 10 onto a PCB, each T-shaped hold down 40 is soldered onto the PCB using e.g. a suitably positioned solder ball on the PCB. Advantageously, the T-shaped hold downs 40 facilitate a better solderability during the connection process, inter alia due to an increased number of corner structures on the solder tail, which can facilitate solderability. The larger surface area to get in contact with the PCB also provides for improved solderability, as well as the T-shape of the hold down 40. Furthermore, the bent hold downs 40, after being solder connected to the PCB, advantageously provide biased movability of the receptacle connector 10 due to the resilience of the metal material, and advantageously in three dimensions. It will be appreciated that more than two hold downs may be provided in different embodiments.

The tail portions e.g. 42, 44, of the electrical terminals 12, 14 are of the surface mount type. It will be appreciated that other tail portion configurations are possible in other embodiments. Access to the tail portions e.g. 42, 44 is provided, in a mounted state of the receptacle connector 10 on a PCB, by respective longitudinal recesses 46, 49 in a peripheral wall 51 of the receptacle connector 10. The recesses 46, 49 form edge openings allowing access to the tail portions e.g. 42, 44 of the electrical terminals 12, 14, the tail portions e.g. 42, 44 being positioned, in a mounted state of the receptacle connector 10 on a PCB, vertically between the surface of the PCB, and the recess wall 51 in the areas of the recesses 46, 49 respectively.

Removable covers 56, 58 are provided on respective sidewalls 59, 60 of the receptacle connector 10, and in the areas of the recesses 46, 49 respectively. The covers 56, 58 are removably connected to the respective sidewalls 59, 60 by mating slide-in connector elements. Details of the connection of the covers 56, 58 to the connector 10 will be described below with reference to FIG. 3. The covers 56, 58 further comprise recesses e.g. 74, 76 formed in respective outer walls 80, 82, for facilitating, in a mounted state of the receptacle connector 10 on a PCB, vertical removal of the covers 56, 58. The covers 56, 58 are inserted after the receptacle connector 10 is mounted on the PCB. The covers 56, 58 can be inserted manually.

The covers 56, 58 advantageously provide protection of the tail portions e.g. 42, 44, and in particular the solder connections to the tail portions e.g. 42, 44 in a connected state of the receptacle on a PCB. For example, the solder connections to the tail portions e.g. 42, 44 may be protected from dust or other particles, which may otherwise damage or deteriorate the solder connections, or may lead to electrical shortening of adjacent solder connections, i.e. terminal connections. In the example embodiment, the covers 56, 58 are moulded from the same material as the receptacle connector 10.

A pick-up device in the form of a metal cap 48 is also shown in FIG. 1. Cap 48 comprises a main body 50, and wall portions e.g. 52 extending from the main body 50. Wall portions corresponding to, and being a mirror image of, wall portions e.g. 52 are provided on the opposite side of the main body 50 (compare also FIG. 3). When the cap 48 is positioned for pick-up of the receptacle connector 10, the wall portions e.g. 52, and the corresponding wall portions on the opposite side (not shown) resiliently engage the sidewalls 59, 60 of the receptacle connector 10.

The receptacle connector 10 further comprises offset locator post 84, 86 formed at opposing ends of the two arrays 11, 13 of terminals 12, 14. In the example embodiment, the locator post 84, 86 are integrally moulded with the receptacle connector 10. As will be appreciated by a person skilled in the art, the locator post 84, 86 facilitate polarizing during mounting of the receptacle connector 10 onto a PCB. It will be appreciated that more than two offset locator posts may be provided in different embodiments.

Figure 2:
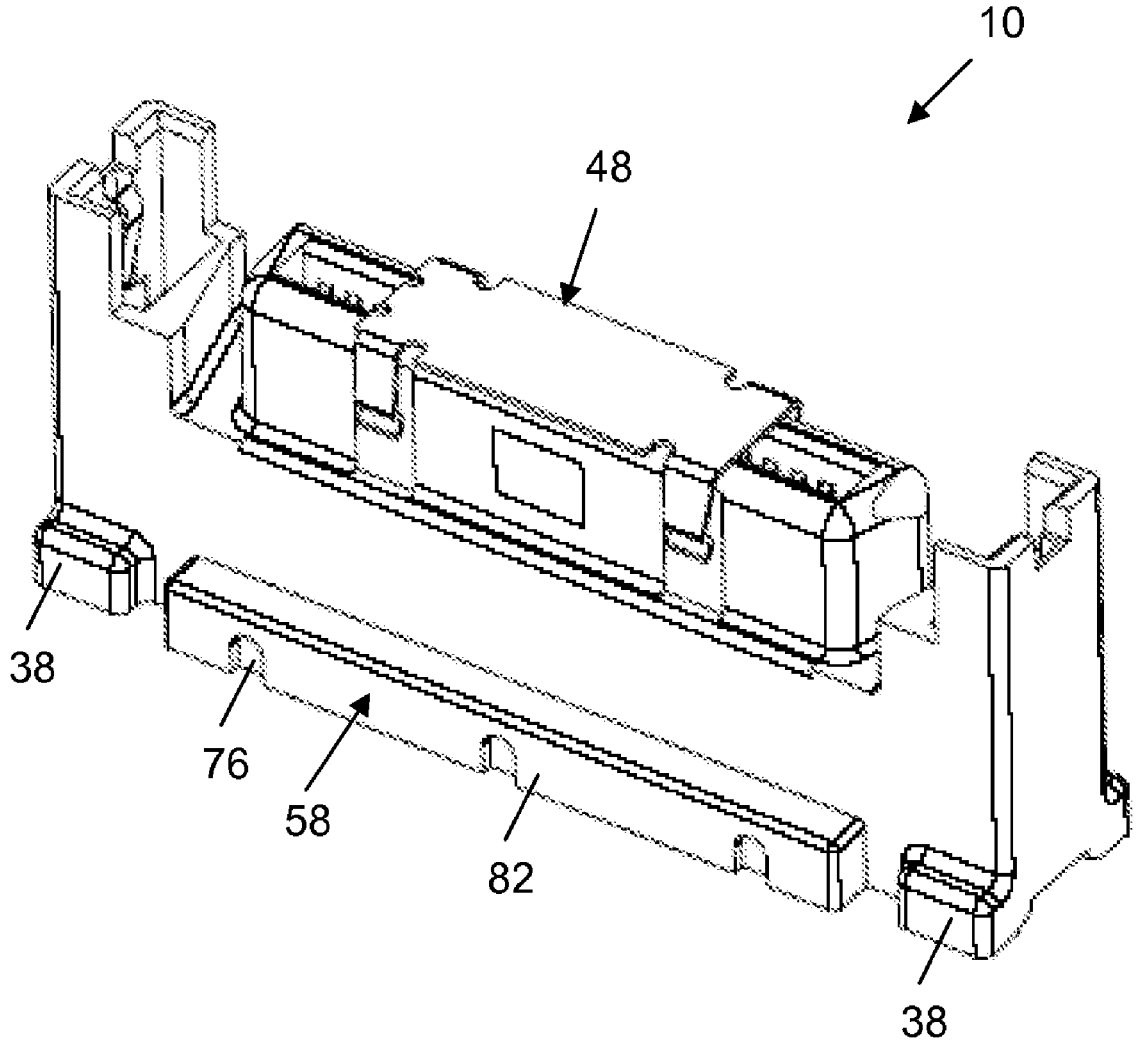
FIG. 2 is a perspective top view of the SCA-2 receptacle connector of FIG. 1.

FIG. 2 shows a perspective top view of the receptacle connector 10, illustrating the positioning of the covers e.g. 58 to protect the tail portions (hidden), in a mounted state of the receptacle connector 10 on a PCB. As described above, recesses or slots e.g. 76 are formed on the outer wall e.g. 82 of the covers e.g. 58, for removal of the covers for inspection and maintenance purposes.

In the example embodiment, the receptacle connector 10 further comprises respective base 38, for providing increased stability in a mounted state of the receptacle connector 10 on a PCB. FIG. 2 also illustrates the metal pick-up cap 48, removably positioned for pick-up of the receptacle connector 10.

Figure 3:
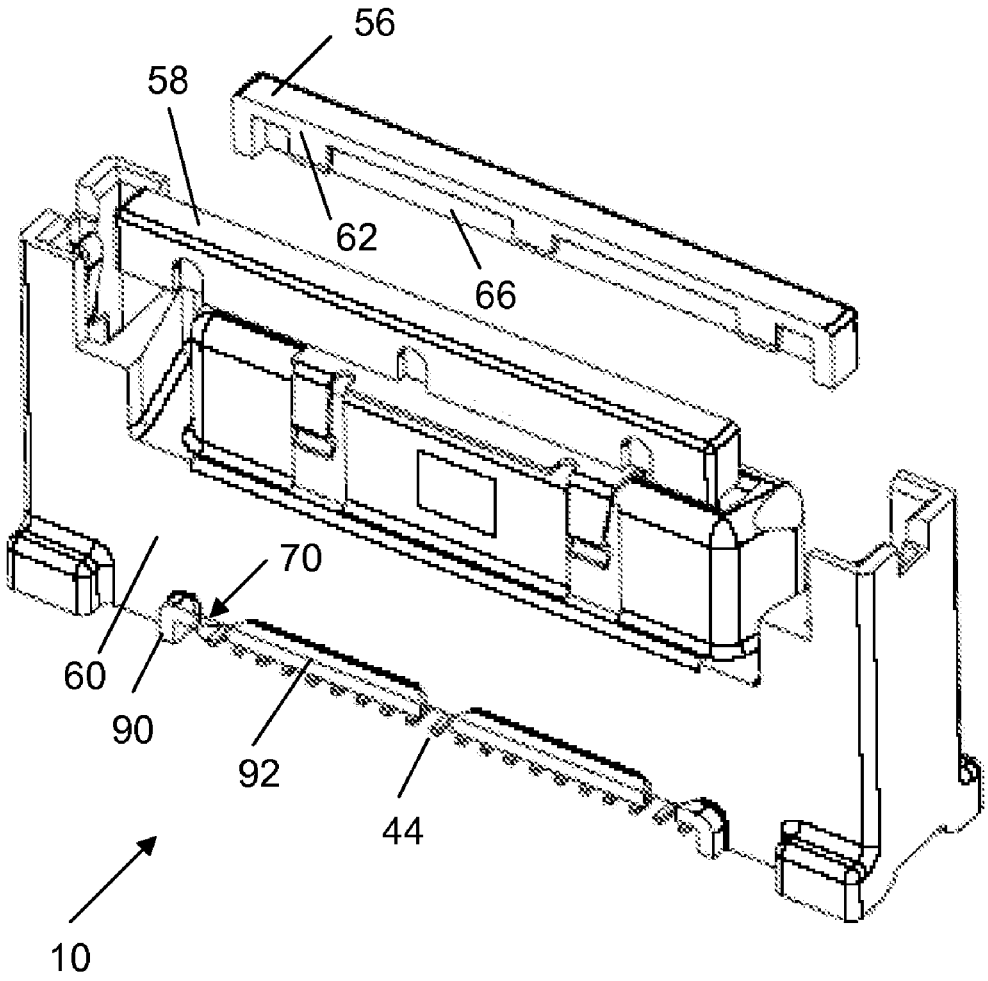
FIG. 3 is a perspective top view of the SCA-2 receptacle connector of FIG. 1, with covers removed.

FIG. 3 shows a perspective top view of the receptacle connector 10, with the covers e.g. 58 removed from the mounted state, exposing the tail portions e.g. 44. As can be seen in FIG. 3, each cover 56, 58 comprises three trapezoidal key elements e.g. 62 one at each end, and one centrally located, for locking the covers 56, 58 to the sidewalls e.g. 60, i.e. to the receptacle connector 10. On the sidewalls e.g. 60, rim portions e.g. 90 are formed to support the covers e.g. 58 in the mounted state, with the key elements being received in slots e.g. 70 between adjacent rim portions, e.g. between rim portions 90 and 92. The trapezoidal key elements e.g. 62 are formed on respective inner walls e.g. 66 thereof. As will be appreciated by a person skilled in art, the trapezoidal key elements are arranged for slide-in engagement into the slots for vertical, frictional slide-in connection of the covers 56, 58 to the respective sidewalls e.g. 60.

Figure 4:
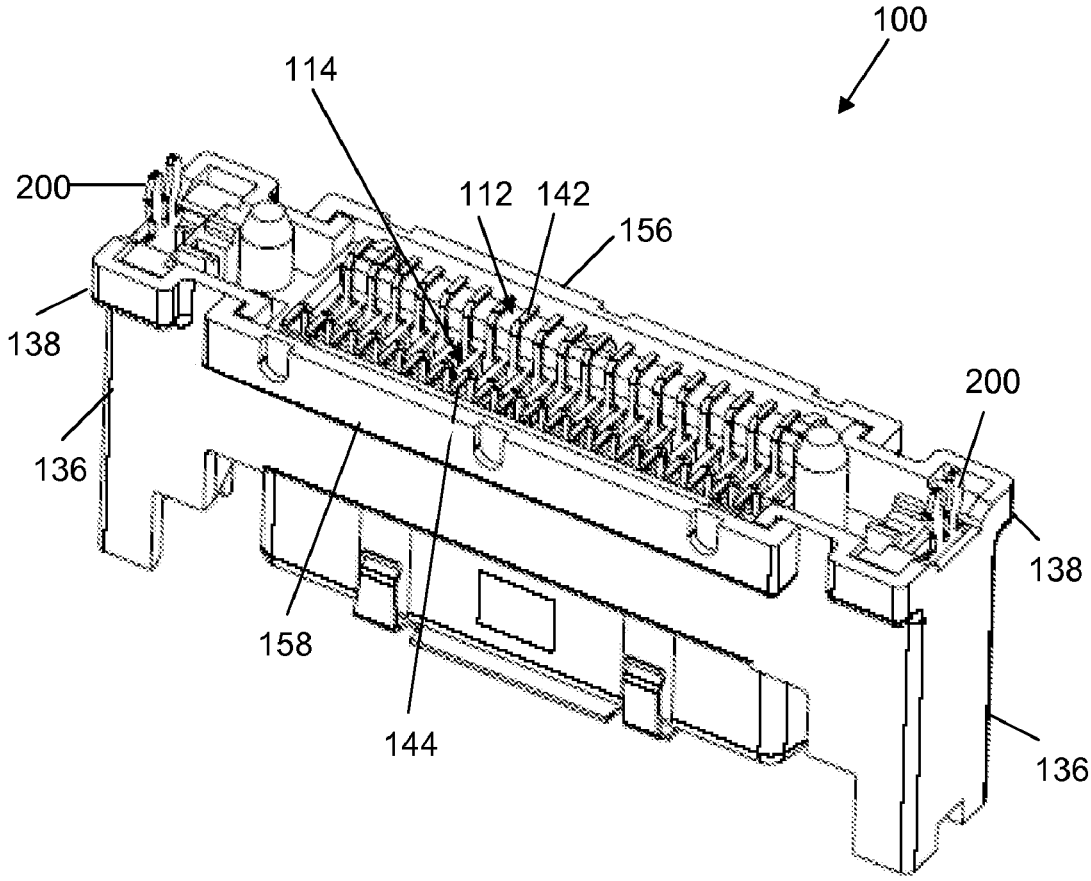
FIG. 4 is a perspective bottom view of the SCA-2 receptacle connector according to another embodiment of the present invention.

FIG. 4 shows a perspective bottom view of a receptacle connector 100 according to another embodiment of the present invention. The receptacle connector 100 is in most regards identical to the receptacle connector 10 described above with reference to FIGS. 1 to 3, in particular in relation to the provision of covers 156, 158 for protection of solder connections to the tail portions e.g. 142, 144 of the electrical terminals 112, 114. In this embodiment, however, the T-shaped hold downs (compare items 40 in FIG. 1), are replaced by metal fork lock clips 200, at each of the ends of the receptacle connector 100, and more particular at the base portions 138 of the pillars 136 at each of the ends of the receptacle connector 100. As will be appreciated by a person skilled in the art, the fork lock clips 200 are arranged for cooperation with corresponding locking elements on a PCB, typically formed in conjunction with a through-opening on the PCB.

The example embodiments described can achieve a number of advantages, including protection of the solder connections to the solder tails of terminals of the receptacle by way of removable covers.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

For example, it will appreciated that the number, shape, and positioning of removable covers can be varied in different embodiments, depending on the overall design of the receptacle, and in particular the disposition of the tail portions of the terminals of the different receptacle designs. Also, it will be appreciated that the removable engagement between the covers and the body of the receptacles can be implemented in a number of different ways, including key elements of any other suitable shape, in different embodiments.

The invention claimed is:

1. An electrical connector comprising a housing;

one or more recesses formed in one or more sidewalls of the housing;

a plurality of terminals disposed in respective portions of the housing such that solder tails of the terminals are accessible through the one or more recesses; and one or more cover elements removably coupled to the one or more sidewalls of the housing such that, in a mounted state of the connector on a PCB, the solder tails are enclosed by the one or more cover elements.

2. The connector as claimed in claim 1, wherein the one or more cover elements include one or more key elements for slide-in coupling to the one or more sidewalls.

3. The connector as claimed in claim 2, wherein the one or more sidewalls include corresponding slots for receiving the key elements.

4. The connector as claimed in claim 3, wherein the one or more key elements and the one or more slots are substantially trapezoidal in cross-sectional shape.

5. The connector as claimed in claim 1, wherein the one or more cover elements further include one or more recesses formed on respective outer walls for facilitating gripping of the respective cover elements for insertion, removal, or both.

6. The connector as claimed in claim 1, further comprising two or more offset locator posts for polarizing the connector in the mounted state.

7. The connector as claimed in claim 1, further comprising two or more substantially T-shaped metallic hold down elements for solder connecting the connector to a PCB.

8. The connector as claimed in claim 7, wherein the T-shaped hold down elements are disposed to be substantially parallel to a surface of the PCB in the mounted state.

9. The connector as claimed in claim 1, further comprising two or more fork lock clips for connecting the connector to a PCB.

10. The connector as claimed in claim 1 where the one or more recesses extend from a top of the one or more sidewalls to a bottom of the one or more sidewalls, and wherein the solder tails extend across the one or more recesses at the bottom of the one or more sidewalls.

11. The connector as claimed in claim 1 where the solder tails extend laterally outward at the one or more exterior sides of one or more sidewalls, and where the one or more cover elements cover an end of the solder tails projecting laterally outward at the one or more sidewalls.

12. The connector as claimed in claim 11 where the one or more cover elements have a bottom side which is substantially flush with bottom surfaces of the solder tails when the connector is mounted to the PCB.

13. The connector as claimed in claim 1 where the one or more cover elements cover a tip of the solder tails which project in a laterally outward direction at the one or more sidewalls.

14. The connector as claimed in claim 1 where the one or more cover elements are removable from the one or more sidewalls of the housing when the connector is in the mounted state on the PCB.

15. An electrical connector comprising a housing;

a plurality of terminals disposed in respective portions of the housing, where the terminals comprise solder tails, where the solder tails extend to one or more exterior sides of one or more lateral sidewalls of the housing;

one or more recesses formed in the one or more lateral sidewalls of the housing, where the one or more recesses are sized and shaped to provide access through opposite ends of the one or more lateral sidewalls to the solder tails; and one or more cover elements removably coupled to the one or more lateral sidewalls of the housing such that, in a mounted state of the connector on a printed circuit board (PCB), the solder tails are enclosed by the one or more cover elements at the exterior sides of the one or more lateral sidewalls.

16. The connector as claimed in claim 15 where the one or more recesses extend from a top of the one or more lateral sidewalls to a bottom of the one or more lateral sidewalls, and wherein the solder tails extend across the one or more recesses at the bottom of the one or more lateral sidewalls.

17. The connector as claimed in claim 15 where the solder tails extend laterally outward at the one or more exterior sides of one or more lateral sidewalls, and where the one or more cover elements cover an end of the solder tails projecting laterally outward at the one or more lateral sidewalls.

18. The connector as claimed in claim 17 where the one or more cover elements have a bottom side which is substantially flush with bottom surfaces of the solder tails when the connector is mounted to the PCB.

19. The connector as claimed in claim 15 where the one or more cover elements cover a tip of each of the solder tails which project in a laterally outward direction at the one or more lateral sidewalls.

20. The connector as claimed in claim 15 where the one or more cover elements are removable from the one or more sidewalls of the housing when the connector is in the mounted state on the PCB.

* * * * *